US011739579B2

(12) United States Patent
Na

(10) Patent No.: US 11,739,579 B2
(45) Date of Patent: Aug. 29, 2023

(54) DISPLACEABLE HINGE UNIT

(71) Applicant: Sung Ho Na, Anyang-si (KR)

(72) Inventor: Sung Ho Na, Anyang-si (KR)

( * ) Notice: Subject to any disclaimer, the term of this patent is extended or adjusted under 35 U.S.C. 154(b) by 171 days.

(21) Appl. No.: 17/433,747

(22) PCT Filed: Mar. 5, 2020

(86) PCT No.: PCT/KR2020/095026

§ 371 (c)(1),
(2) Date: Aug. 25, 2021

(87) PCT Pub. No.: WO2020/185057

PCT Pub. Date: Sep. 17, 2020

(65) Prior Publication Data

US 2022/0145680 A1 May 12, 2022

(30) Foreign Application Priority Data

Mar. 8, 2019 (KR) ..... 10-2019-0026597

(51) Int. Cl.
*E05D 7/04* (2006.01)
*E05F 3/20* (2006.01)

(52) U.S. Cl.
CPC ..... *E05D 7/0423* (2013.01); *E05F 3/20* (2013.01); *E05D 2007/0469* (2013.01); *E05D 2700/02* (2013.01)

(58) Field of Classification Search
CPC ..... E05D 7/0423; E05D 7/0415; E05D 2007/0453; E05D 2007/0469;
(Continued)

(56) References Cited

U.S. PATENT DOCUMENTS 525,712 A * 9/1894 Knittel ..... E05D 7/0027 16/244
983,553 A * 2/1911 Hunter ..... E05D 7/0027 16/244

(Continued)

FOREIGN PATENT DOCUMENTS

EP 2169163 3/2010
KR 20000022161 4/2000

(Continued)

OTHER PUBLICATIONS

International Search Report—PCT/KR2020/095026 dated Sep. 4, 2020.

*Primary Examiner* — Chuck Y Mah
(74) *Attorney, Agent, or Firm* — CANTOR COLBURN LLP

(57) ABSTRACT

A displaceable hinge unit is provided. The displaceable hinge unit includes: an outer frame having an insertion groove formed on a longitudinal center portion of a first lateral surface thereof; a shaft rotatably disposed in the outer frame by passing through the insertion groove of the outer frame, and having a screw thread formed on an outer circumferential surface thereof located in the insertion groove; and an inner frame having a screw thread that is formed on an inner circumferential surface thereof and is engaged with the screw thread of the shaft, and configured to form translational motion in the insertion groove by means of rotation of the shaft.

4 Claims, 3 Drawing Sheets

(58) Field of Classification Search
CPC ..... E05D 2700/02; Y10T 16/53247; Y10T 16/53238; Y10T 16/5325
See application file for complete search history.

(56) References Cited

U.S. PATENT DOCUMENTS 1,341,690 A * 6/1920 Werner ..... E05D 7/0027 16/244
2,351,298 A * 6/1944 Shogran ..... E05D 15/00 16/244
2,373,955 A * 4/1945 Fuller ..... E05D 7/0423 126/194
2,725,589 A * 12/1955 Papesh ..... E05D 5/023 16/236
2,779,966 A * 2/1957 Torchia ..... E05D 7/0027 16/244
5,666,695 A * 9/1997 Jegers ..... E05D 7/1022 16/389
5,720,082 A 2/1998 Rossmo
5,826,306 A * 10/1998 Faubert ..... E05D 15/1021 16/244
5,933,919 A * 8/1999 Miller ..... E05D 7/0018 16/244
6,276,025 B1 * 8/2001 Leibman ..... E05D 5/06 16/241
8,561,261 B2 * 10/2013 Gibson ..... E05D 11/04 16/386
2002/0023311 A1 * 2/2002 Holt ..... E05D 7/0027 16/221
2005/0120517 A1 * 6/2005 Bonham ..... E05D 3/10 16/238
2005/0183238 A1 * 8/2005 McCue ..... E05D 7/0027 16/236
2012/0291223 A1 * 11/2012 Gibson ..... E05D 11/02 16/274
2015/0330129 A1 * 11/2015 Hendrickson, Jr. ..... E05D 7/00 16/244

FOREIGN PATENT DOCUMENTS

KR 101323599 11/2013
KR 101613825 4/2016
KR 101947919 2/2019

* cited by examiner

DISPLACEABLE HINGE UNIT

TECHNICAL FIELD

The present disclosure relates to a displaceable hinge unit capable of easily realizing position adjustment of a door coupled to a door frame.

BACKGROUND ART

A door is connected to a storage body or an interior space that is open at one surface to open and close the storage body or the interior space by a door hinge.

The door hinge may be realized in various shapes, and include: an outer frame coupled to the storage body or the interior space; an inner frame coupled to the door; and a shaft disposed by passing through the outer frame and the inner frame.

As an example, Korean Patent No. 10-1947919 (Title of invention: Door hinge with semi-automatic closer function and stopper function) proposes a door hinge. Although names are different from as described above, the door hinge includes an outer hinge frame, an inner hinge frame, and a shaft.

In the conventional door hinge, the outer frame and the inner frame may be respectively coupled to the storage body and the door by bolting or welding.

However, the conventional door hinge may have a problem of mis-accuracy in opening and closing position between the door and the storage body as time passes due to incorrect initial coupling position of the outer frame and the inner frame or door weight, etc.

When such a problem occurs, the conventional door hinge has inconvenience of requiring readjustment of a bolting position, and even in a welded door hinge, re-adjustment of a coupling position is difficult.

DISCLOSURE

Technical Problem

Accordingly, the present disclosure has been made keeping in mind the above problem occurring in the related art, and an objective of the present disclosure is to provide a hinge unit having a simple structure and capable of easily performing vertical displacement of a door position while remaining in an initial coupling position thereof.

Technical Solution

In order to achieve the above objective, the present disclosure provides a displaceable hinge unit including: an outer frame having an insertion groove formed on a longitudinal center portion of a first lateral surface thereof; a shaft rotatably disposed in the outer frame by passing through the insertion groove of the outer frame, and having a screw thread formed on an outer circumferential surface thereof located in the insertion groove; and an inner frame having a screw thread that is formed on an inner circumferential surface thereof and is engaged with the screw thread of the shaft, and configured to perform translational motion in the insertion groove by means of rotation of the shaft.

The outer frame may be configured such that a second lateral surface thereof may be bent twice in one direction.

The shaft may have a first end having a hexagonal bolt-shaped outer surface and the first end of the shaft may be disposed to protrude outward of the outer frame.

The shaft may have a first end in which a screwdriver groove may be formed on an upper surface thereof and the first end of the shaft may be disposed to protrude outward of the outer frame.

The inner frame may include: a first housing in which the screw thread of the inner frame engaged with the screw thread of the shaft is formed on the inner circumferential surface thereof; a second housing accommodating an outer circumferential surface of the first housing therein; and a plurality of balls or rollers arranged between the first housing and the second housing.

Advantageous Effects

According to the present disclosure, the shaft is rotatably disposed on the outer frame and the inner frame is easily moved in one direction by rotating the shaft. Accordingly, regardless of coupling preciseness of the hinge unit with respect to a door or a storage body or displacement of a door in response to use of the door, accuracy in opening and closing the door can be improved by displacing a position of the door.

According to the present disclosure, the inner frame is realized in the form of a bearing, so that movement of the first housing for rotation and position adjustment of the second housing in response to opening and closing of the door is separately performed. A position of the door corrected by movement of the first housing may be stably maintained.

MODE FOR INVENTION

Figure 1:
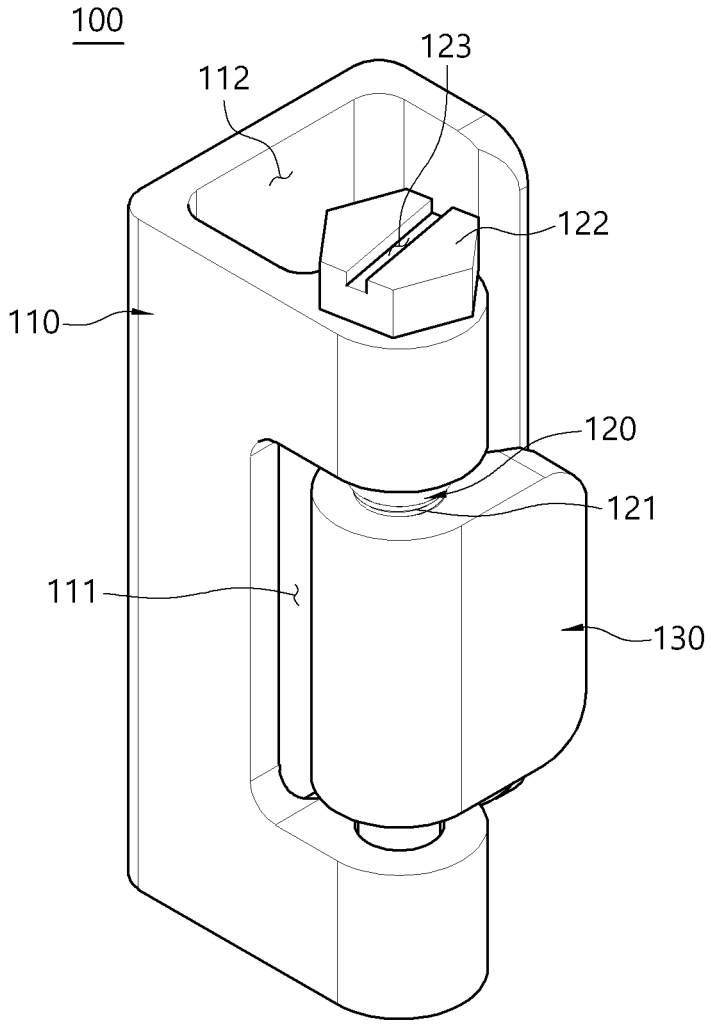
FIG. 1 is a perspective view showing a displaceable hinge unit according to an embodiment of the present disclosure.

Hereinbelow, a preferred embodiment of the present disclosure will be described in detail with reference to accompanying drawings.

Unless otherwise defined, all terms including technical and scientific terms used herein have the same meaning as commonly understood by one of ordinary skill in the art to which the present disclosure belongs. When terms used herein are different from the commonly understood meaning, the terms will be interpreted as defined herein.

However, the terminology used herein is for the purpose of describing embodiments of the present disclosure only and the scope and spirit of the present disclosure are not limited to the embodiment described hereinbelow. The same reference numerals will be used throughout the description to refer to the same or like parts.

Figure 2:
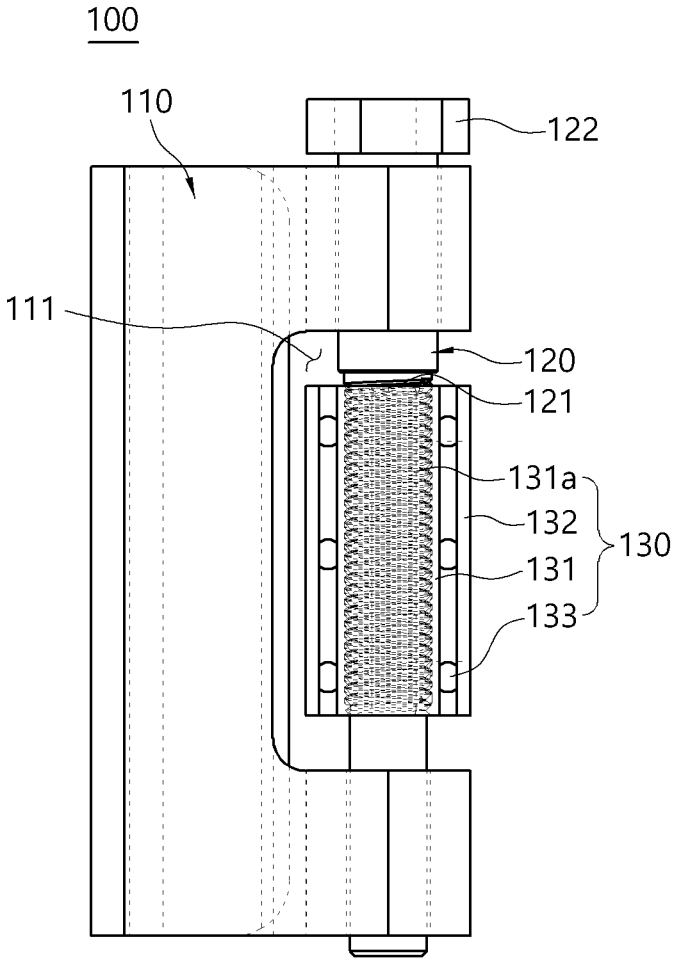
FIG. 2 is a side sectional view showing the displaceable hinge unit in FIG. 1.
Figure 3:
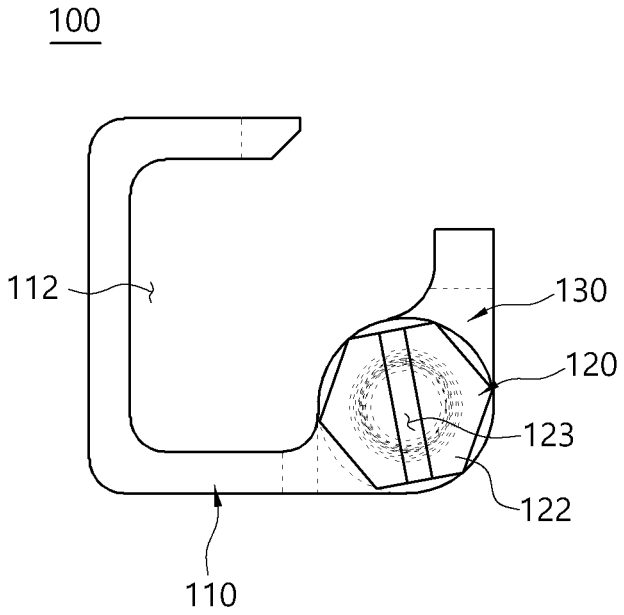
FIG. 3 is a top view showing the displaceable hinge unit in FIG. 1.

FIG. 1 is a perspective view showing a displaceable hinge unit according to an embodiment of the present disclosure. FIG. 2 is a side sectional view showing the displaceable hinge unit in FIG. 1. FIG. 3 is a top view showing the displaceable hinge unit in FIG. 1.

Referring to FIGS. 1 to 3, the displaceable hinge unit 100 according to the embodiment of the present disclosure may include an outer frame 110, a shaft 120, and an inner frame 130.

The outer frame 110 may be coupled to a door, or a storage body or an interior space of a building opened and closed by a door. The outer frame 110 may be coupled to the door by bolting or welding.

The outer frame 110 may have an insertion groove 111 formed on a center portion of a first lateral surface thereof in order to dispose the inner frame 130.

The first lateral surface of the outer frame 110 is divided into opposite surfaces of the insertion groove 111 by the insertion groove 111 formed on the center portion thereof. The shaft 120, which will be descried below, may be disposed by passing through the first lateral surface of the outer frame 110.

A second lateral surface of the outer frame 110 may bent twice in one direction, and a bent portion 112 formed as described above may allow the outer frame 110 to be precisely coupled to one lateral surface of a door, or one lateral surface of a storage body or an entrance of the interior space of a building that are opened and closed by a door without deformation of a coupling angle.

Although not shown in the drawings, the outer frame 110 may have at least two coupling holes for bolting.

The shaft 120 is rotatably disposed in the outer frame 110 by passing through the insertion groove 111 of the outer frame 110. A screw thread 121 may be formed on an outer circumferential surface thereof located in the insertion groove 111.

The shaft 120 is disposed on the first later surface of the outer frame 110 by passing through the insertion groove 111, and is rotatable while remaining in the disposed position.

A first end 122 of the shaft 120 may have a hexagonal bolt-shaped outer surface and be disposed to protrude outward of the outer frame 110. A user can easily rotate the shaft 120 by using a tool such as a spanner.

The first end 122 of the shaft 120 may have a screwdriver groove 123 formed on an upper surface thereof and be disposed to protrude outward of the outer frame 110. The user can easily rotate the shaft 120 by using a tool such as a cross-head screwdriver or a flat-heat screwdriver.

The inner frame 130 may be coupled to a storage body or an interior space of a building that are opened and closed by a door, or to a door. The inner frame 130 may be coupled to the storage body or the interior space of the building by bolting and welding.

Although not shown in the drawings, the inner frame 130 may have at least two coupling holes for bolting.

The inner frame 130 may have a screw thread 131*a* that is formed on an inner circumferential surface thereof and is engaged with the screw thread 121 of the shaft 120. The inner frame 130 may perform translational motion in the insertion groove 111 by means of rotation of the shaft 120.

In order for the inner frame 130 to be moved in the insertion groove 111, the inner frame 130 should be fixed to an object such as a door.

Since a position of the screw thread 131*a* engaged with the shaft 120 may be displaced by the rotation of the door, the inner frame 130 may have a structure like a bearing.

Specifically, the inner frame 130 may include: a first housing 131 having the screw thread 131*a* of the inner frame engaged with the screw thread 121 of the shaft 120 on an inner circumferential surface thereof; a second housing 132 accommodating an outer circumferential surface of the first housing 131 therein; and a plurality of balls or rollers 133 disposed between the first housing 131 and the second housing 132.

The inner frame 130 may be realized in a structure like a ball bearing or a roller bearing, and when the door is formed of a metal material with a heavy weight, the inner frame 130 may be realized in the structure of a roller bearing.

According to the present disclosure, as the first housing 131 is moved vertically in the insertion groove 111 by the rotation of the shaft 120, the inner frame 130 and the door are entirely moved vertically so that a position of the door may be adjusted. As the second housing 132 rotates the door without affecting the first housing 131, the door of which the position is adjusted may remain in the adjusted position.

Although the preferred embodiment of the present disclosure has been disclosed for illustrative purposes, those skilled in the art will appreciate that various modifications, additions and substitutions are possible, without departing from the spirit and scope of the present disclosure.

The invention claimed is:

1. A displaceable hinge unit comprising:

an outer frame having an insertion groove formed on a longitudinal center portion of one side portion thereof;

a shaft rotatably disposed in the outer frame by passing through the insertion groove of the outer frame, and having a screw thread formed on an outer circumferential surface thereof located in the insertion groove; and an inner frame having a screw thread that is formed on an inner circumferential surface thereof and is engaged with the screw thread of the shaft, and configured to perform translational motion in the insertion groove by means of rotation of the shaft, wherein the inner frame comprises:

a first housing in which the screw thread of the inner frame engaged with the screw thread of the shaft is formed on the inner circumferential surface thereof;

a second housing accommodating an outer circumferential surface of the first housing therein; and a plurality of balls or rollers arranged between the first housing and the second housing.

2. The displaceable hinge unit of claim 1, wherein the outer frame is configured such that the other side portion thereof is bent twice in one direction.

3. The displaceable hinge unit of claim 1, wherein the shaft has a first end having a hexagonal bolt-shaped outer surface and the first end of the shaft is disposed to protrude outward of the outer frame.

4. The displaceable hinge unit of claim 1, wherein the shaft has a first end in which a screwdriver groove is formed on an upper surface thereof and the first end of the shaft is disposed to protrude outward of the outer frame.

* * * * *